United States Patent [19]

Bell

[11] Patent Number: 4,801,050

[45] Date of Patent: Jan. 31, 1989

[54] OUTLET TUBE RESTRICTOR

[76] Inventor: Michael Bell, c/o 36-275 King Street East, Toronto, Ontario, Canada, M5A 1K2

[21] Appl. No.: 28,928

[22] Filed: Mar. 23, 1987

[51] Int. Cl.[4] ..... B65D 37/00

[52] U.S. Cl. ..... 222/212; 222/214; 222/485; 251/9

[58] Field of Search ..... 251/4, 7–8, 251/9–10; 604/250; 222/105, 206, 212, 213, 214–215, 526–530, 556, 485

[56] References Cited

U.S. PATENT DOCUMENTS

| | | | |
|---|---|---|---|
| 2,665,876 | 1/1954 | Hopfield | 251/4 X |
| 3,429,549 | 2/1969 | Swanson | 604/250 X |
| 3,512,748 | 5/1970 | Wilson | 604/250 X |
| 3,865,107 | 2/1975 | Barton | 604/250 X |
| 4,312,342 | 1/1982 | Chittenden | 604/250 X |
| 4,434,963 | 3/1984 | Russell | 251/7 |
| 4,651,898 | 3/1987 | Bell | 222/129 |

FOREIGN PATENT DOCUMENTS

| | | | |
|---|---|---|---|
| 108603 | 9/1939 | Australia | 604/250 |
| 19730 | 1/1903 | Canada . | |
| 866653 | 3/1971 | Canada . | |
| 891367 | 1/1972 | Canada . | |
| 974145 | 9/1975 | Canada . | |

*Primary Examiner*—Michael S. Huppert
*Attorney, Agent, or Firm*—Armstrong, Nikaido, Marmelstein & Kubovcik

[57] ABSTRACT

A flow control device for controlling the flow rate of liquid through a flexible tube which comprises a body having sides and a slot to receive the flexible tube passing through the body. The slot commences at one of the sides of the body and the length of the slot is sufficient to receive most of the tube. The slot has sides spaced apart a predetermined distance sufficient to bear against the sides of the tube when in position in the slot to deform the tube inwardly and evenly along those sides a sufficient degree to provide an even, predetermined reduced flow rate through the tube. Because the tube is constricted in a routine manner by the slot of the device, a predictable reduced flow rate can be achieved for outlet tubes of a similar construction and diameter, making it possible to achieve a predetermined, proper flow rate through that tube. This device provides surprising reliability when used on a tube in conjunction with a liquid dispensing outlet controller, for simultaneous flow of milk from a bag of whole milk and a bag of reconstituted powdered milk, to achieve proper relative flow rates through the tubes from the two bags of milk.

5 Claims, 1 Drawing Sheet

OUTLET TUBE RESTRICTOR

BACKGROUND OF THE INVENTION

The present invention relates to a flow equalizer device for a commercial milk dispenser system which provides palatable milk by dispensing simultaneously into a receptacle a combination of whole milk and reconstituted skim milk.

It is well know that a palatable milk substitute can be obtained by combining homogenized fluid milk and powdered skim milk. Such a combined product produces considerable savings, since an equal volume of powdered skim milk is significantly cheaper than homogenized, partly skim (e.g. 2%) or skim milk. While in a domestic environment there is no problem in blending powdered skim milk with homogenized fluid milk to produce such a palatable whole milk substitute, problems develop in applying this practice to large scale institutions. Essentially, labour costs eliminate the cost savings which would otherwise result. As well, previously there has not been an efficient, sanitary method of mixing such milk.

Conventionally, for large institutions, about the only way of producing such a palatable milk substitute is to mix the powdered skim milk and water in proper proportions in a pail, portion the resultant mixture and add homogenized or partly skim milk.

There is presently available for commercial use in the marketplace powdered milk in a twenty liter capacity bag having a flexible outlet tube adaptable to commercial milk dispensers. The purchaser simply fills the bag with water prior to use. This eliminates the necessity of measuring water or powder, since the powder is in the right proportion in the bag for the size of the bag. Such bags however may have different sized outlet tubes and thus dispense their contents at differing flow rates.

Conventional gravity flow milk dispensers consist of insulated cabinets within which, usually, either a single or double compartment for holding milk is found. A front door provides access to the compartment or compartments within which one or more milk containers sit. In one form of such a milk dispenser, one or more cages sit within the compartment, each to hold, for example, a twenty liter milk bag having a flexible outlet tube at its bottom. A single liquid outlet controller having a mechanism for pinching the outlet tube from the milk bag within, is positioned in front of each compartment on the outside of the milk dispenser cabinet. The valve is handle-operated so that the consumer, by manipulating the handle, obtains the desired amount of milk in a glass or other receptacle positioned beneath that tube outlet. In double compartment dispensers, two such outlet controllers are provided, one for each container or cage. Milk is dispensed under gravity flow.

In my co-pending U.S. application Ser. No. 680,720, now U.S. Pat. No. 4,651,898, a liquid dispenser outlet controller is described and illustrated which provides simultaneous dispensing, under gravity flow and combination in a receptacle, of proper (preferably almost equal) proportions of homogenized whole milk and reconstituted powdered skim milk. These two types of milk are held in separate bags with their own, individual outlet tubes. This controller consists of a channel defined by walls within which channel outlet tubes from each of the liquid containers pass. Retainer means are associated with the channel to maintain the positioning of the tubes within the channel a similar distance with respect to one of the walls of the channel. A tube pinch valve having a surface parallel to that wall of the channel is positioned on the opposite side of the tubes with respect to that wall. Movement of this valve by the operator causes the pinch valve surface to move in parallel fashion with respect to that wall between a position proximal to, but spaced from the wall to pinch off simultaneously the flow of liquid through the tubes in a position more distant from the wall which permits unobstructed simultaneous gravity flow of liquid through each of the tubes.

Such an outlet controller device may be used in combination with a conventional gravity flow milk dispenser cabinet or with any other appropriate structure for holding the bags of whole milk and reconstituted powdered skim milk.

One of the problems which has been experienced in using such a device arises because of the previously-mentioned fact that not all of the flexible tubes of the milk bags are of the same cross-sectional diameter. Hence flow rates between the bag of whole milk and the bag of reconstituted powdered skim milk may differ. This may become significant since ideally the powdered skim milk bag should empty just before the whole milk bag. In this way a constant quality and good flavour of the milk dispensed by the system is achieved. If, on the other hand, the whole milk bag were to be emptied first, reconstituted powdered skim milk, which has an inferior flavour to that of the whole milk, would continue to be dispensed alone, resulting in a less palatable product. As well, for an acceptably good flavour of product, it is important to equalize, as much as possible, the flow rates of the milk as it is dispensed through each of the outlet tubes. When bags of whole and reconstituted powdered skim milk of similar volume of contents are used, the flow rates should thus be similar or the flow rate of the powdered skim milk should be slightly greater than that of the whole milk (to ensure emptying of the reconstituted powdered skim milk bag first).

One solution which one might think of for this problem would be to pass the outlet tube having the higher flow rate through a smaller hole, for example in the retainer means, to constrict the internal diameter of the outlet tube at one point and thereby restrict the flow. This would produce an unpredictable flow rate however since the same diameter tube will crimp differently from one time to the next when passed through such a constricting hole.

Of general background interest to the present invention are U.S. Pat. No. 4,434,963 of Russell issued Mar. 6, 1984 and U.S. Pat. No. 3,429,549 of Swanson issued Feb. 25, 1969. The Russell U.S. patent describes and illustrates a side clamp for flexible medical tubing that includes a slot dividing the clamp into two sides, the slot having a wide area where full flow through the tube is permitted and a narrow area where complete closure of the tube is achieved. The two halves of the clamp are capable of flexure towards and away from each other to facilitate disposition of the tubing within the narrow portion of the slot. The Swanson reference describes and illustrates a metering device circumscribing a flexible tube and having a bore which may be adjustably flattened to constrict the flow through the tube. Neither of these devices would be practical for use in conjunction with a milk dispenser outlet controller device of the type in question.

It is an object of the present invention to provide a device which can be used in conjunction with the aforementioned type of liquid dispenser outlet controller and can be applied to one outlet tube to approximate or equalize uniformly the flow rate through that outlet tube with that of the other outlet tube.

SUMMARY OF THE INVENTION

In accordance with the present invention there is provided a flow control device for controlling the flow rate of liquid through a flexible tube which comprises a body having sides and a slot to receive the flexible tube passing through the body. The slot commences at one of the sides of the body and the length of the slot is sufficient to receive most of the tube. The slot has sides spaced apart a predetermined distance sufficient to bear against the sides of the tube when in position in the slot to deform the tube inwardly and evenly along those sides a sufficient degree to provide an even, predetermined reduced flow rate through the tube. In a preferred embodiment the body is planar and is provided with a tab extending out of the plane of the body along the side opposite from that having the slot, the tab for securing to a support surface to hold the device in position. As well, the sides of the slot are preferably parallel.

The flow control device according to the present invention may be provided with slots of varying sizes, with a slot of appropriate size being selected, depending upon the size of the flexible outlet tube to be held within the slot, so that there is a proper reduced rate of flow of liquid through the tube. Because the tube is constricted in a routine manner by the slot of the device, a predictable reduced flow rate can be achieved for outlet tubes of a similar construction and diameter, making it possible to achieve a predetermined, proper flow rate through that tube. Thus, although relatively simple in construction, the device according to the present invention provides surprising reliability, when used on a tube in conjunction with the aforementioned liquid dispensing outlet controller in achieving proper relative flow rates through the tubes from the two bags of milk.

BRIEF DESCRIPTION OF THE DRAWINGS

These and other objects and advantages of the invention will become apparent upon reading the following detailed description and upon referring to the drawings in which.

Figure 1:
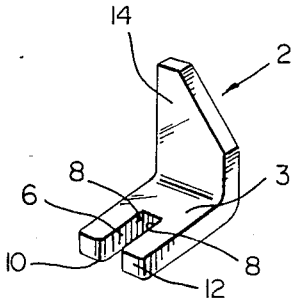
FIG. 1 is a perspective view of a flow control device in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 2:
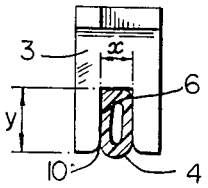
FIG. 2 is a plan view of the device of FIG. 1, from above.

Turning to FIGS. 1 and 2 there is shown a flow control device 2 having an integral planar body 3 for controlling the flow rate of liquid through a flexible tube 4 in accordance with the present invention. Device 2 is provided with a slot 6, the sides 8 of which extend, in parallel fashion, from a bevelled entrance 10 in side 12 of the device. The length y of the slot is sufficient to receive most of the tube, as illustrated, even when constricted by sides 8 of the slot. Sides 8 of the slot are spaced apart a predetermined distance x. This distance is selected so that sides 8 bear against the sides of the tube 4, when in position in the slot as illustrated in FIG. 2, to deform the tube inwardly and evenly along those sides a sufficient degree to provide an even, predetermined flow rate of liquid through the tube which flow rate is reduced from that which would exist were the tube undeformed by device 2.

Thus, the width x may be varied from one control device to another as determined by the thickness and internal diameters of the walls of the flexible tube and the flow rate desired for such tube.

Figure 3:
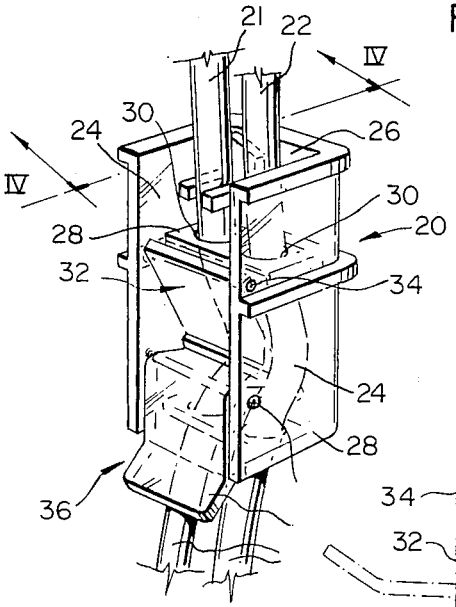
FIG. 3 is a perspective view of the device of FIG. 1 secured to a liquid dispenser outlet controller.
Figure 4:
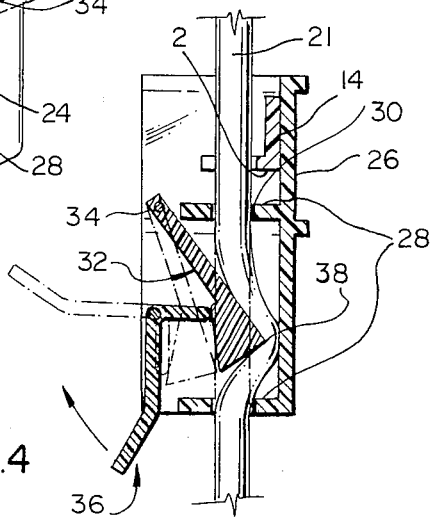
FIG. 4 is a section view along line IV—IV of FIG. 3.

Device 2 is further provided with an upstanding tab or extension 14, illustrated as being positioned at 90° to the surface of planar body 3, this tab extending upwardly from the side of body 3 opposite side 12. As can be seen in FIG. 3, this tab is used as a means for securing, for example by glue or otherwise, device 2 to a liquid dispenser outlet controller 20. Liquid dispenser outlet controller 20 provides for simultaneous dispensing, under gravity, of liquid through flexible tubes 21 and 22, these tubes coming from, for example, respectively a bag of whole milk and a bag of reconstituted powdered skim milk (not shown) preferably having a similar volume of contents and being held in a conventional gravity flow milk dispenser cabinet (again not shown). Outlet controller 20 is secured to such a cabinet within a channel defined by vertically oriented side walls 24 and back wall 26. Within this channel outlet tubes 21 and 22 pass. Tubes 21 and 22 are maintained in position by retainer plates 28 having tube-receiving apertures 30. The tubes, when in position in these apertures, are maintained a similar distance with respect to back wall 26. Flow of liquid through tubes 21 and 22 is simultaneously permitted or obstructed by means of a tube pinch valve 32 which is pivotably secured to side walls 24 at point 34. Handle mechanism 36 is movable to bear against a surface of pinch valve 32 and cause a pinching surface 38 (FIG. 4) to move in parallel fashion with respect to the back wall 26, to pinch off simultaneously the flow of liquid through tubes 21 and 22. When handle 36 is in open position (phantom in FIG. 4) that surface of handle 36 no longer presses against pinch valve 32 and that pinch valve surface 38 moves away from wall 28 to permit simultaneous flow of liquid through each of the tubes. As can be seen in FIGS. 3 and 4, the device 2 is secured to back wall 26 of controller 20, by means of tab 14, so that outlet tube 21 is positioned within slot 6, the flow of liquid through that outlet tube being appropriately constricted by the edges 8 of the slot of this device. In this way, the flow of fluid through tube 21, which for example may be of a larger internal diameter than tube 22, is reduced by means of flow control device 2 to be about the same as the flow of liquid through tube 22 when handle 36 and pinch valve 32 are in their open, free-flow position (phantom, FIG. 4).

When a liquid dispenser outlet controller is being set up for simultaneous, equal flow of liquid through two tubes 21 and 22, it may be necessary to experiment with flow control devices 2 having slots 6 of different width x until an appropriate flow rate through the normally-faster-flowing of the two outlet tubes is achieved. As well, it may occasionally be necessary to achieve proper flow to use a pair of devices 2, one for each of the tubes 21 and 22, having slots 6 of appropriate width. Once an appropriate slot width has been determined and device 2 installed, it should not normally be necessary to change device 2 since, usually, bags of milk from the same source have outlet tubes with walls of similar internal diameters and thickness.

Thus, it is apparent that there has been provided in accordance with the invention a flow control device that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A liquid dispenser outlet controller for simultaneous dispensing under gravity of liquid through flexible outlet tubes, one each from two independent liquid containers, the outlet controller having a channel defined by vertically oriented walls within which channel the outlet tubes from each liquid container pass, retainer means associated with the channel to maintain the positioning of the tubes within the channel a similar distance with respect to one of the walls of the channel, a tube pinch valve having a surface parallel to said one of the walls of the channel positioned on the opposite side of the tubes with respect to the wall, this valve being moveable to move the pinch valve surface in parallel fashion with respect to said one wall between a position proximal to but spaced from the wall to pinch off simultaneously the flow of liquid through the tubes, and a position more distant from the wall which permits simultaneous flow of liquid through each of the tubes, the dispenser outlet controller having a flow control device for controlling the flow rate of liquid through one of the outlet tubes secured to one of the walls of the channel above the pinch valve, the flow control device comprising a body having sides, a slot passing through the body to receive the flexible tube, the slot having an entrance commencing at one of the sides of the body, the length of the slot being sufficient to receive most of the tube, the slot having sides spaced apart a predetermined distance sufficient to bear against the sides of the tube when in position in the slot to deform the tube inwardly and evenly along those sides a sufficient degree to provide an even, predetermined reduced flow rate through the tube, one of the tubes passing through the slot thereof, the width of the slot being such as to permit relatively similar flow of liquid through the tubes when the pinch valve is in open position.

2. A controller according to claim 1 wherein the sides of the slot of the flow control device are parallel and beat against opposite sides of the tubing.

3. A controller according to claim 2 wherein opposite sides of the slot at its entrance at the said one side of the body are bevelled to facilitate insertion of the tube into the slot from that side of the body.

4. A controller according to claim 2 wherein the body of the flow control device is planar.

5. A device according to claim 4 wherein the flow control device is further provided with a tab extending out of the plane of the body along the side, opposite from that having the slot therein, the tab provided for securing the device to the wall of the channel.

* * * * *